US005692428A

United States Patent [19]

Sonntag

[11] Patent Number: 5,692,428

[45] Date of Patent: Dec. 2, 1997

[54] FLUID-POWERED CYLINDER

[75] Inventor: Udo Sonntag, Kamp-Lintfort, Germany

[73] Assignee: Imi Norgren GmbH, Alpen/Niederrhein, Germany

[21] Appl. No.: 583,752

[22] Filed: Jan. 17, 1996

[30] Foreign Application Priority Data

Jan. 20, 1995 [GB] United Kingdom ..... 9501117

[51] Int. Cl.[6] ..... F15B 15/22

[52] U.S. Cl. ..... 91/26; 91/394; 91/408; 92/85 B; 92/88

[58] Field of Search ..... 91/26, 405, 407, 91/408, 409, 394; 92/85 R, 85 B, 88

[56] References Cited

U.S. PATENT DOCUMENTS 2,911,952 11/1959 Peras ..... 91/394
3,820,446 6/1974 Granbom et al. ..... 92/88

FOREIGN PATENT DOCUMENTS 0502 810 A 9/1992 European Pat. Off. .
3110132 9/1982 Germany ..... 91/394

*Primary Examiner*—F. Daniel Lopez
*Attorney, Agent, or Firm*—Cushman Darby & Cushman Intellectual Property Group of Pillsbury Madison & Sutro LLP

[57] ABSTRACT

A rodless pneumatic cylinder includes main exhaust ports defined by the open ends of a pair of fixed tubular members that extend, respectively, into the cylinder body from its opposed ends. The main piston of the rodless cylinder has an axial bore formed in it in which is slidably mounted a small piston that serves mutually to isolate the working chambers of the cylinder. The bore carries seals adjacent to its opposed ends whereby, during motion of the piston, the bore sealingly receives one or other of the tubular members at a predetermined stage during the motion thereby effectively closing the main exhaust port. During further motion of the piston, air can, therefore, exhaust only through a throttled auxiliary exhaust port and such further motion of the piston is thus cushioned. The arrangement provides for a greater extent of cushioning relative to known arrangements in which the working chambers are mutually isolated by a barrier fixedly secured in the bore.

4 Claims, 1 Drawing Sheet

FLUID-POWERED CYLINDER

Figure 1A:
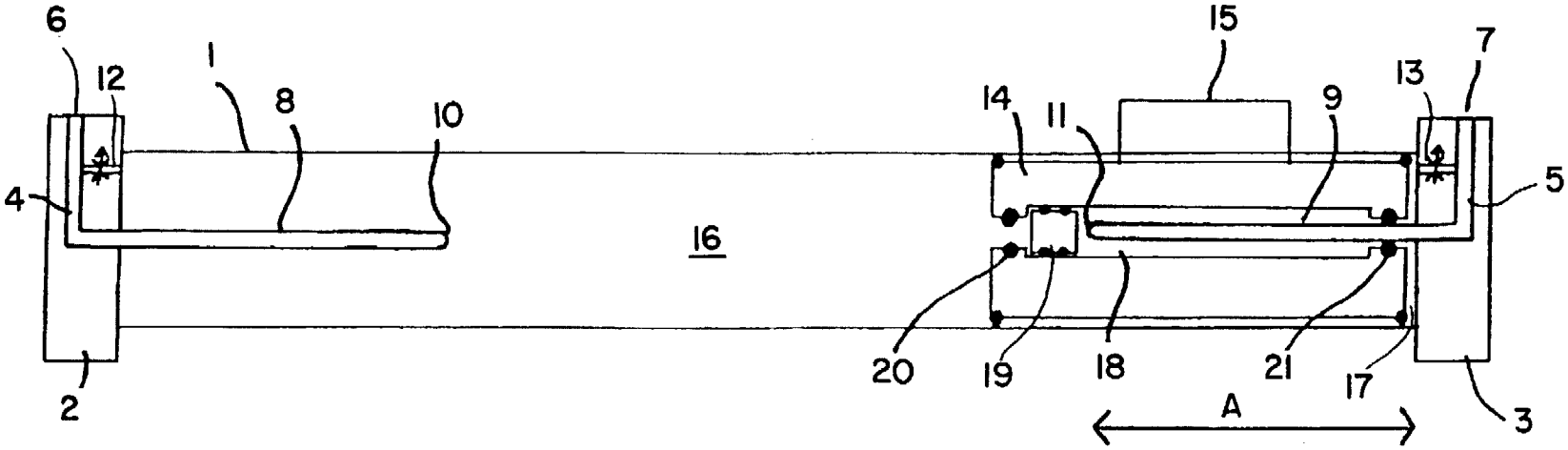

This invention relates to fluid-powered rodless cylinders especially, but not exclusively, pneumatic rodless cylinders.

It is well known to damp or "cushion" the motion of a pneumatic cylinder as it approaches the end of a stroke. The main purpose of such cushioning is to prevent possible damage to the load being actuated by the cylinder and/or to the cylinder itself as could occur if the piston were to strike the end of the cylinder body at high velocity.

In the case of fluid-powered, in particular pneumatic, rodless cylinders, a known cushioning arrangement comprises a pair of openended fixed ducts, for example tubes, that extend longitudinally into the cylinder bore from the respective, opposed ends thereof. The respective innermost open ends of the ducts define the main exhaust ports (and optionally the main fluid supply ports) and the opposed ends of the cylinder bore are each provided with an auxiliary, restricted exhaust port. Further, the main piston of the rodless cylinder has a bore extending longitudinally therethrough which carries, at or adjacent to its opposed ends, a pair of annular seals. The bore in the main piston is centrally partitioned by a fixed wall which serves mutually to isolate the two chambers defined by the cylinder bore on either side of the main piston. Towards the end of each stroke, the appropriate one of the fixed ducts (that is to say the duct towards which the piston is moving during that particular direction of stroke and through which air is being exhausted) will be sealingly received in the bore in the main piston whereby air can no longer exhaust through the duct. However, upon continued motion of the main piston to the end of the stroke air exhausts through the appropriate auxiliary exhaust port, but at a reduced rate relative to the rate of exhaust through the duct, whilst the piston slides over the duct. The continued movement is thereby cushioned. Because of the fixed partition wall in the bore in the main piston, a hitherto unsolved problem is that the portion of each stroke during which cushioning is possible is limited to a distance equal to about half the length of the bore in the main piston or, in other words, to about half the length of the main piston.

The present invention addresses that problem and is concerned with an improvement to the known arrangement described above whereby a significantly increased cushioning length may be achieved. Indeed, the improvement may afford cushioning over a distance up to more or less equal to the length of the piston, ie. more or less twice that possible in the known arrangement, as will be explained later herein.

According to the present invention, therefore, there is provided a fluid-powered rodless cylinder wherein the main exhaust ports are defined by the innermost open ends of a pair of fixed tubular ducts that extend longitudinally into the cylinder bore from, respectively, the opposed ends of the bore, wherein the main piston slidably located in the cylinder bore has a bore extending longitudinally therethrough having therein partition means mutually to isolate the two chambers defined by the cylinder bore on either side of the main piston and wherein an auxiliary exhaust port is provided at each end of the cylinder bore, the arrangement being such that, at a pre-determined stage during motion of the main piston, one or other, as appropriate, of the tubular ducts is sealingly received in the bore in the main piston so that air can no longer exhaust through that duct but exhausts solely through the respective auxiliary exhaust port, whereby continued motion of the main piston is cushioned, characterised in that the said partition means is longitudinally moveable in the bore in the main piston, preferably substantially from one end thereof to the other end thereof.

Preferably, the partition means comprises a short cylindrical member, in the nature of a piston, that preferably carries, for example in one or more external annular recesses, one or more seals that form a fluid-tight seal with the wall of the bore in the main piston, although the fluid-tight seal could be glandless.

Preferably, the bore in the main piston is of reduced diameter at or adjacent to its ends thus providing respective abutment shoulders which serve to retain the partition means within the bore.

The necessary fluid-tight seal between the bore in the main piston and one or other of the ducts when received therein is conveniently achieved, as in the known arrangement, by sealing means carried at or adjacent to the ends of the bore in the piston, but appropriate sealing means could, in principle, instead be mounted on each duct at or adjacent to its innermost open end.

In a preferred embodiment (and as in the known arrangement described above) the fixed ducts are in the form of tubes of externally circular cross-section and they serve also to supply pressurised working fluid, such as compressed air, to the cylinder, the main exhaust/supply mode of the ducts being alternated, in use, by means of a conventional directional control valve. In such an embodiment, the aforesaid sealing means are of a "one-way" nature, that is to say that they permit the passage of fluid from the bore in the piston back into the adjacent chamber defined by cylinder bore, but not vice-versa.

The invention is applicable to any type of rodless cylinder, for example of the type in which the motion transfer element is magnetically coupled to the main piston, in which it is coupled to the main piston by a band or the like, or in which it is mechanically coupled to the main piston as, for example, is described and claimed in European patents Nos 68088 and 69199 to which the reader is referred.

Figure 1B:
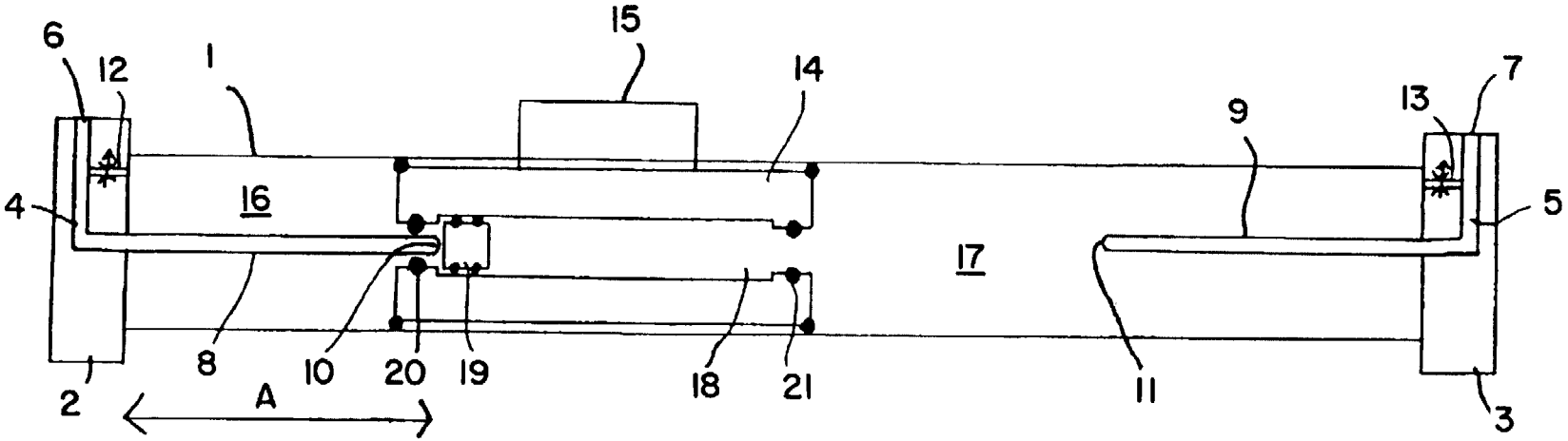

A rodless cylinder constructed in accordance with the invention will now be described in more detail, by way of example only, with reference to the accompanying drawings in which:

FIG. 1*a* is a schematic, sectional side elevation of the cylinder at the end of its rightwards stroke/beginning of its leftwards stroke; and FIG. 1*b* is a similar view to that of FIG. 1*a* during the leftwards stroke at the commencement of cushioned motion of that stroke.

Referring to the drawings, the rodless cylinder comprises an elongate hollow cylindrical body 1, for example in the form of an aluminium extrusion, which is closed by end caps 2 and 3. The end caps 2 and 3 are formed with respective passageways 4 and 5 which at their outer ends are threaded at 6 and 7 respectively for connection to a directional control valve (not shown), as is conventional. The inner ends of the passageways 4 and 5 are connected to, respectively, a pair of fixed tubes 8 and 9, supported by the end caps 2 and 3 respectively, that extend axially into the body 1 and that are open at their innermost ends to define main fluid inlet/exhaust ports 10 and 11 respectively.

Each of the end caps 2 and 3 is also formed with an auxiliary exhaust passageway 12 and 13 respectively, each of which is provided with a throttle which is fixed, or as shown in the drawings, adjustable.

The hollow cylindrical body 1 defines a bore having slidably mounted in it a main piston assembly 14 to which is secured a motion transfer element 15. The motion transfer element 15 projects through a sealed slot formed in, and extending along the whole of the length of, the body 1. Further details of the construction and operation of this type of rodless cylinder may be found in, for example, the above-mentioned European patent specifications.

The main piston assembly 14 thus partitions the cylinder bore into right- and left-hand chambers 16 and 17 respectively into which compressed air is alternatively fed, by way of the directional control valve, in order to actuate the cylinder and cause it to perform reciprocating strokes. As can be seen, the ports 10 and 11 communicate respectively with the chambers 16 and 17.

The main piston assembly 14 has an axial bore 18 formed in it which steps down, near its ends, to a slightly smaller diameter. The larger diameter portion of the bore 18 has sealingly and slidably mounted in it a small piston 19 which serves to isolate the chamber 16 from the chamber 17. The two slightly smaller diameter end portions of the bore 18 each carry "one-way" seals 20 and 21 respectively which allow fluid to flow from the bore 18 into the chambers 16 and 17 respectively but not vice versa. Consider first FIG. 1*a*, which shows the main piston assembly 14/motion transfer element 15 at the end of its rightwards stroke with the tube 9 fully received in the bore 18. Upon supply of compressed air to the passageway 5 via the directional control valve, pressurised air issues from the port 11 into the bore 18 and can, via the seal 21, enter the chamber 17 thus fully pressurising it. The main piston 14 therefore commences its leftwards stroke. Upon further execution of that stroke, the main piston 14 eventually becomes disengaged from the tube 9 and continues its leftwards motion. During the aforementioned stages, air in the chamber 16 exhausts to atmosphere via the port 10, the tube 8, the passageway 4 and the directional control valve.

Eventually, the main piston 14 reaches the position shown in FIG. 1*b* where it has just engaged the tube 8. More particularly, the one-way seal 20 initially engages the end of the tube 8 (which end is chamfered to facilitate the engagement) and air can therefore no longer exhaust from the chamber 16 through the tube 8. Rather, upon continued leftwards movement of the main piston 14 the tube 8 is progressively received in the bore 18 and air in the chamber 16 exhausts at a much reduced rate through the restricted, auxiliary passageway 12, the passageway 6 and the directional control valve. Continued movement of the main piston 14 is therefore cushioned. During that continued movement, the small piston 19 is urged rightwards, relative to the main piston 14, by physical contact with the end of the tube 8. Eventually, the main piston 14 reaches the end of its leftwards stroke with the tube 8 fully received with the bore 18 in the main piston 14. As will be appreciated, cushioning will therefore be effective over the length A indicated in FIGS. 1*a* and 1*b* which equates more or less to the length of the tubes 8 and 9 and is significantly more than half the length of the main piston 14 which is the maximum achievable using the known arrangement. Indeed, the extent A of cushioning could be increased further by lengthening the tubes 8, 9 and reducing the length of the piston 19, up to a maximum extent only slightly less than the length of the main piston 14.

The cylinder is now ready to execute its rightwards stroke and this will commence upon change-over of the directional control valve, which then supplies compressed air to the passageway 4 and, via the one-way seal 20, the chamber 16, whereas the port 11, tube 9 and passageway 5 become connected to atmosphere (exhaust) through the directional control valve. Rightwards motion, and eventual cushioning, of the main piston 14 takes place in precisely the same way as for the leftwards stroke described above, cushioning becoming effective upon engagement of the tube 9 by the seal 21.

The effective cushioning length A during each stroke (which of course may be different as between the leftwards and rightwards strokes by using tubes 8 and 9 of respectively different lengths) may be easily varied simply by altering the lengths of the tubes 8 and/or 9.

As will be appreciated, the full extent A of cushioning can occur during a stroke even if the immediately preceding stroke is not fully completed. This feature is useful in the context of passenger railway carriage doors actuated by cylinders of the invention where, because of an obstruction by passengers during closing of the doors, they are caused to re-open and then close once the passengers are clear of the doors.

I claim:

1. In a fluid-powered rodless cylinder comprising a body having a cylinder bore extending axially along the body, a main piston slidably located in the cylinder bore and dividing the cylinder bore into a chamber on each side of the main piston, the main piston having an open-ended bore extending longitudinally therethrough in which is located a partition portion to mutually isolate the two chambers, a pair of main exhaust ports defined, respectively, by innermost open ends of a pair of fixed tubular ducts that extend longitudinally into said chambers from opposite ends of said cylinder bore, and an auxiliary exhaust port provided at each end of the cylinder bore, the arrangement being such that, at a pre-determined stage during motion of the main piston, one of the tubular ducts is sealingly received in the piston bore so that fluid can no longer exhaust through that tubular duct but exhausts through the respective auxiliary exhaust port, whereby continued motion of the main piston is cushioned, the improvement wherein said partition portion is longitudinally moveable in the main piston such that during the continued motion of the main piston, said partition portion abuts the innermost open end of that duct while said main piston can continue to move relative to said duct and the partition portion.

2. A fluid-powered rodless cylinder according to claim 1 wherein the partition portion comprises a piston.

3. A fluid-powered rodless cylinder according to claim 2 wherein the main piston carries one or more annular sealing means for effecting a fluid-tight isolation of the two chambers.

4. A fluid-powered cylinder according to claim 1 wherein the piston bore in the main piston is of reduced diameter near its opposed ends thereby defining respective abutment shoulders that serve to retain the partition portion within the piston bore.

* * * * *